US010251437B1

(12) United States Patent
Jhin et al.

(10) Patent No.: US 10,251,437 B1
(45) Date of Patent: Apr. 9, 2019

(54) MANUFACTURE FOR HAIR ACCESSORY AND METHODS THEREFOR

(71) Applicant: JBS Hair Inc., Doraville, GA (US)

(72) Inventors: Eddie K Jhin, Duluth, GA (US); Jae Hoon Lee, Suwanee, GA (US)

(73) Assignee: JBS Hair Inc., Doraville, GA (US)

( * ) Notice: Subject to any disclaimer, the term of this patent is extended or adjusted under 35 U.S.C. 154(b) by 440 days.

(21) Appl. No.: 14/640,936

(22) Filed: Mar. 6, 2015

(51) Int. Cl.
*A41G 5/00* (2006.01)

(52) U.S. Cl.
CPC ..... *A41G 5/0046* (2013.01)

(58) Field of Classification Search
CPC ..... A41G 5/00; A41G 5/0046; A41G 5/004; A41G 3/0075
USPC ..... 206/823
See application file for complete search history.

(56) References Cited

U.S. PATENT DOCUMENTS 1,257,393 A * 2/1918 Reifsnyder ..... B65D 5/0245 206/424
5,722,434 A * 3/1998 Walker ..... A41G 5/0073 132/201
8,439,237 B2 5/2013 Choi
8,590,543 B2 11/2013 Goff et al.
8,800,827 B2 8/2014 Choi
9,220,329 B1 * 12/2015 Kim ..... A45C 11/00
2009/0289088 A1 * 11/2009 Choi ..... A45D 44/005 223/84
2011/0132942 A1 6/2011 Choi

OTHER PUBLICATIONS

"Publication", C Curl Remy Bob—Flyer; Eve Hair Inc.; Publication Date Unknown but believed to be prior to filing of present application.

* cited by examiner

*Primary Examiner* — Cris L. Rodriguez
*Assistant Examiner* — Brianne E Kalach
(74) *Attorney, Agent, or Firm* — Philip H. Burrus, IV

(57) ABSTRACT

A manufacture includes a hair accessory (200,300) comprising a weft (201,301) and a plurality of hair strands (202, 302), a film layer (411), and a support (1206). The weft can be arranged in a coil (408) along the film layer with the plurality of hair strands extending outwardly from the coil. The plurality of hair strands can be parted (1101,1102) to define a first subset of hair strands (1103) extending substantially in a first direction (1105) from the coil and a second subset of hair strands (1104) extending substantially in a second direction from the coil to form a parted hair assembly (1109). The parted hair assembly can then be wrapped about the support so as to preserve a one directional curl in the hair, as well as offer consumers a way to inspect both the interior side (1204) and the exterior side (1205) without disturbing the curl or coil.

14 Claims, 13 Drawing Sheets

-- PRIOR ART --

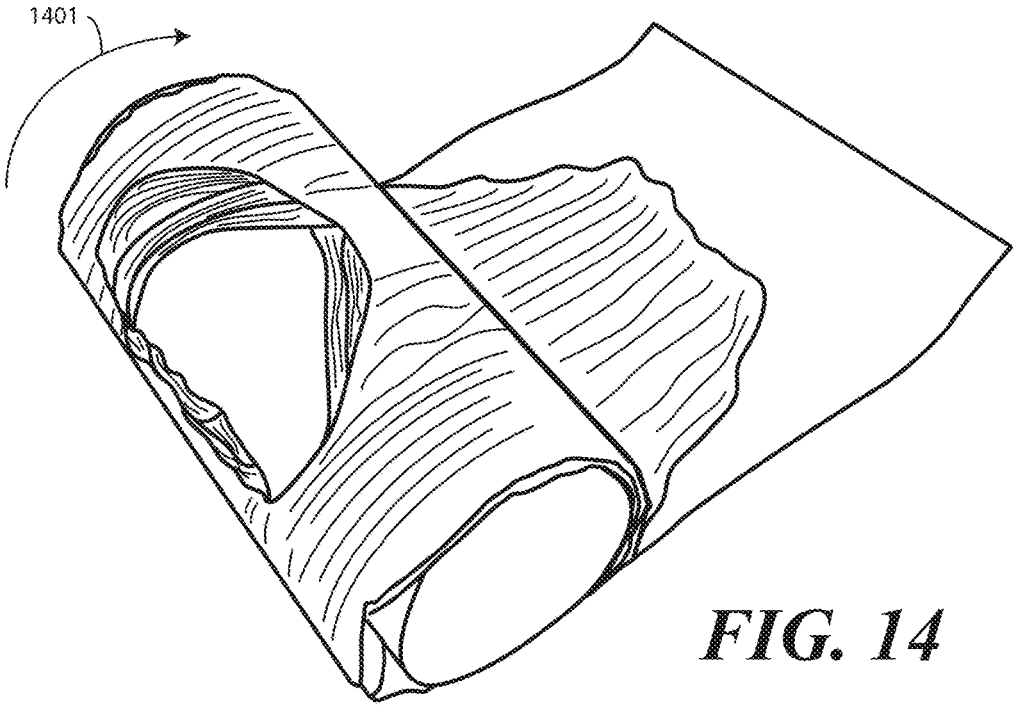
FIG. 14
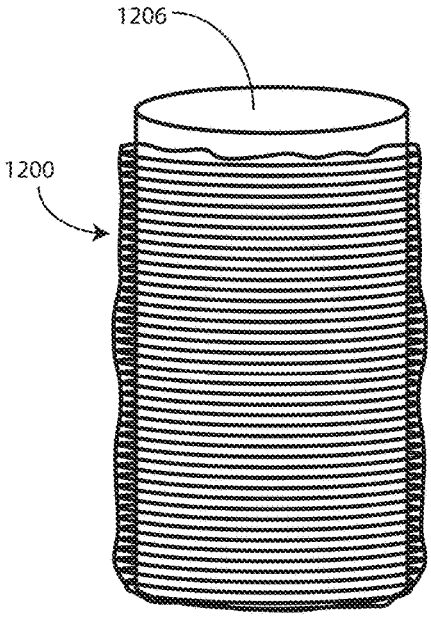
FIG. 15
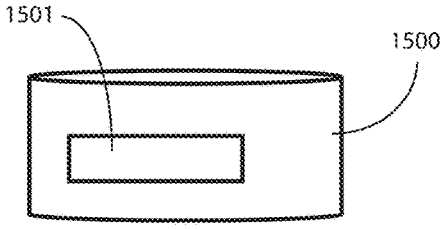

MANUFACTURE FOR HAIR ACCESSORY AND METHODS THEREFOR

BACKGROUND

Technical Field

This disclosure relates generally to manufactures, and more particularly to a manufacture to package hair.

Background Art

Hair accessories, including weaves and extensions, are becoming increasingly popular fashion accessories. Many people enjoy augmenting their natural hair with weaves or extensions.

Human or synthetic hair is attached to a "weft." The weft is a natural or synthetic strip to which the hair is attached. The weft can take various forms, including stitched and fused forms. The hair can be stitched to the weft or fused to the weft by an adhesive or thermal fusion process. The hair extends from a common side of the weft. When applying extensions using wefts of hair, the wefts are clipped or otherwise attached between rows of a person's natural hair to create stylistic effects, fashion effects, overall length, body, and so forth.

People desiring such extensions are frequently discerning customers. For example, they may select human hair for a more natural look, despite the fact that human hair can be significantly more expensive than synthetic hair. Additionally, consumers understand that wefts of hair come in varying quality levels, with examples including Brazilian wefts of hair, Indian wefts of hair, and Malaysian wefts of hair, to name a few. The highest quality human hair generally is sold in its most natural state, thereby allowing the user to style the hair as desired by applying curls or other modifications. Hair can be sold as wave, natural curl, and tight curl, with natural curl commanding premiums.

When purchasing wefts of hair, especially natural curl hair, these discerning customers desire the hair extending from the weft to curl in a single direction. If the hair curls in multiple directions or has non-uniform curling configurations, it is less desirable. Many prior art packaging for wefts of hair is deficient in that the packaging itself applies multi-directional or non-uniform curls due to the way that the hair is manipulated and stored in the package. It would be advantageous to have an improved manufacture for packaging wefts of hair.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

FIG. 14 illustrates one or more method steps to construct an explanatory manufacture in accordance with one or more embodiments of the disclosure.

FIG. 15 illustrates a parted hair assembly being wrapped about a support and a band.

Figure 1:
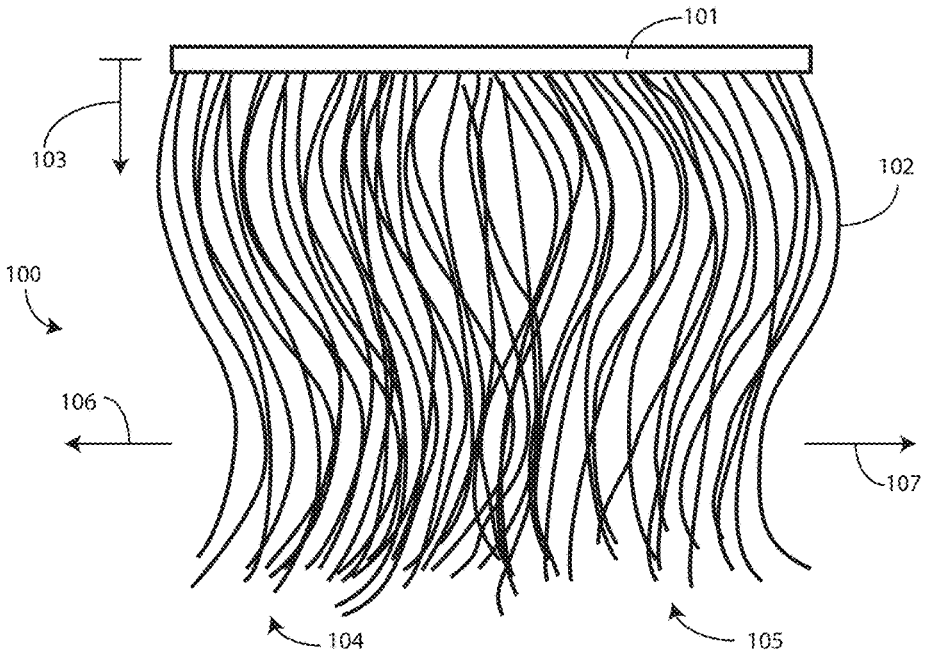
FIG. 1 illustrates a prior art weft of hair after packaging.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The term "manufacture" is used as that term is defined in Section 2105 of the Manual of Patent Examining Procedure, which is consistent with the way that term was used by the United States Supreme Court in *Diamond v. Chakrabarty,* 447 U.S. 303 (1980), namely "the production of articles for use from raw materials prepared by giving to these materials new forms, qualities, properties, or combinations whether by hand labor or by machinery." Also, reference designators shown herein in parenthesis indicate components shown in a figure other than the one in discussion. For example, talking about a device (10) while discussing figure A would refer to an element, 10, shown in figure other than figure A.

As noted above, it is desirable to package wefts of hair such that any curl occurs in a single direction for substantially all strands of hair extending from a weft. Advantageously, embodiments of the disclosure do just that: they provide a manufacture that curls of substantially all of a plurality of hair strands extending from a weft define a one directional curl. Moreover, embodiments of the disclosure provide a simple, attractive, and cost-effective packaging assembly with which discerning customers may examine and select wefted hair without the need of handling the hair or, in many instances, even removing it from its packaging.

Numerous other advantages will be obvious to those of ordinary skill in the art having the benefit of this disclosure.

In one embodiment, a manufacture comprises a hair accessory, a film layer, and a support. In one embodiment, the hair accessory comprises a weft and a plurality of hair strands extending distally from a common side of the weft.

In one or more embodiments, the weft is arranged in a coil along the film layer with the plurality of hair strands extending outwardly from the coil. In one or more embodiments, the plurality of hair strands are then parted after the coil is formed to define a first subset of hair strands and a second set of hair strands. In one embodiment the first set of hair strands extends substantially in a first direction along an axis from the coil while a second subset of hair strands extends substantially in a second direction along the axis from the coil to form a parted hair assembly.

The parted hair assembly can then be wrapped about the support. In one embodiment, the support is placed atop the parted hair assembly and the support is rotated along the axis such that the parted hair assembly winds about the support. This wrapping along the axis ensures that that curls of substantially all of a plurality of hair strands extending from a weft define a one directional curl that is a function of the diameter of the support. Moreover, the parted hair assembly is easily removed from the support so that prospective purchasers or users of the hair accessory can inspect both the interior side of the hair accessory and the exterior side of the hair accessory without ever removing it from the film layer. The parted hair assembly can then simply be wrapped again about the support to repackage the hair accessory without affecting or altering the one directional curl.

Turning now to FIG. 1, illustrated therein is a prior art hair weft 100. The prior art hair weft 100 comprises a weft 101 and strands of hair 102. The strands of hair 102 are attached to the weft 101 and extend from a common side 103 of the weft 101. As shown in FIG. 1, the strands of hair 102 have curls 104,105 that curl in two different directions 106,107. This can be a function of the prior art hair weft 100 having a low quality grade. However, it is more frequently the case that the prior art hair weft 100 is a high-quality hair weft that was placed in prior art packaging, which requires twisting and manipulation of the strands of hair 102. Consequently, when the prior art hair weft 100 spends more than a few hours in the packaging, these different direction curls 104, 105 set. Consumers find curls 104,105 that curl in different directions 106,107 to be less than desirable.

Figure 2:
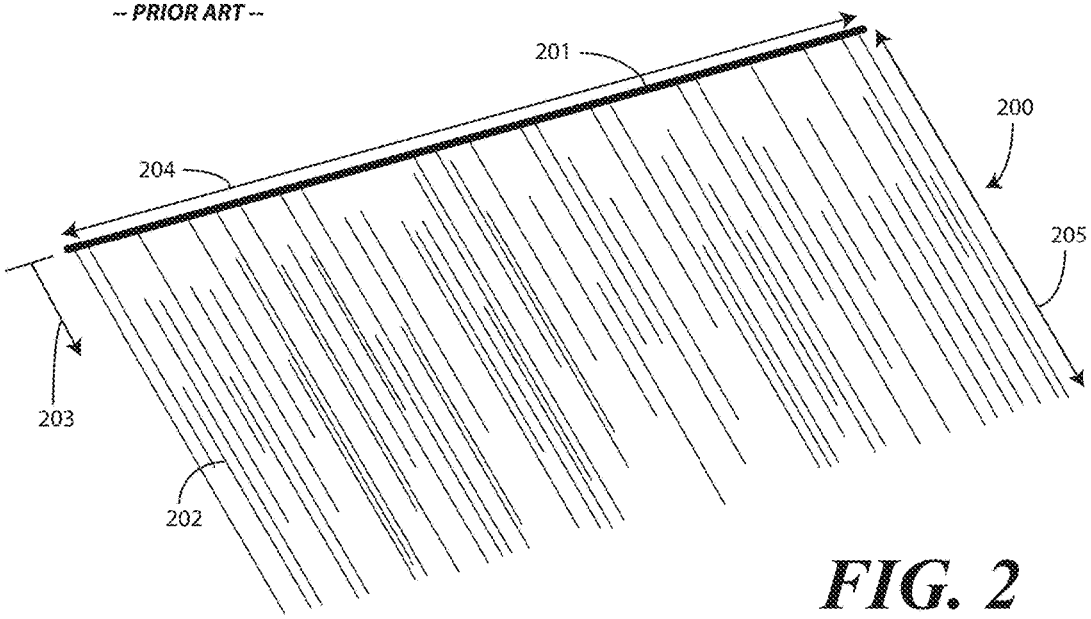
FIGS. 2-3 illustrate an explanatory weft of hair in accordance with one or more embodiments of the disclosure.
Figure 3:
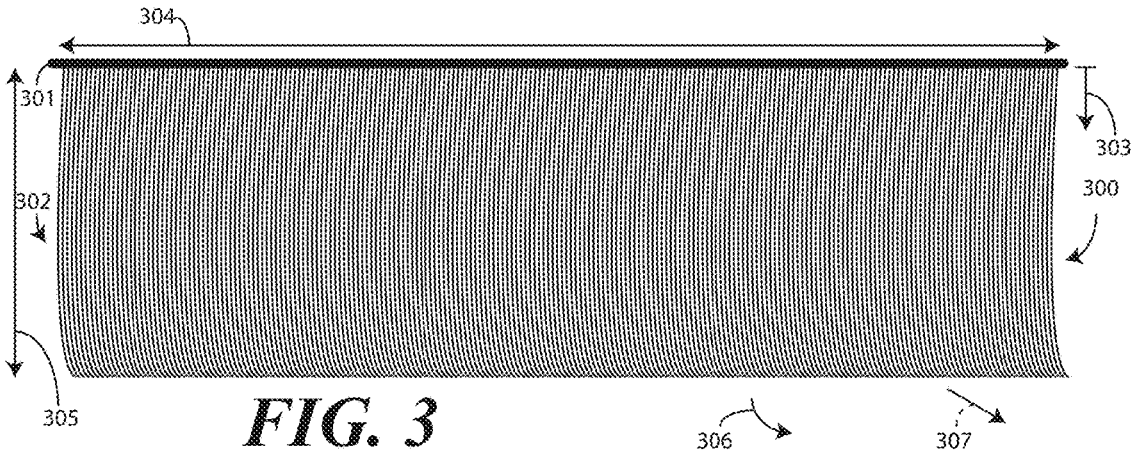

Turning now to FIGS. 2 and 3, illustrated therein are hair accessories 200,300 configured in accordance with one or more embodiments of the disclosure. Each of these hair accessories 200,300 includes a weft 201,301 and a plurality of hair strands 102,202. The weft 201,301 can comprise an elongated band of material, such as a synthetic or natural textile material, elasticized material, or other material. The plurality of hair strands 102,202 extends distally from a common side 203,303 of each weft 201,301, respectively.

The weft 201,301 can come in a variety of lengths, from as little as a few inches to more than one hundred inches. In one embodiment, each weft 201,301 has a length 204,304 of between ten and one hundred inches. In one embodiment, the weft 201,301 is at least ten inches in length 204,304 such that a user can cut the weft 201,301 to a desired shape for attachment between rows of natural hair.

The plurality of hair strands 202,302 is fixedly attached to the wefts 201,301. Illustrating by example, the plurality of hair strands 202,302 can be attached to the weft 201,301 by stitching, adhesive coupling, or thermal bonding methods. Other methods of attaching the plurality of hair strands 202,302 to the weft 201,301 will be obvious to those of ordinary skill in the art having the benefit of this disclosure.

In one embodiment the plurality of hair strands 202,302 each comprise human hair strands that are cut from a human's head and attached to the weft 201,301. In another embodiment, the plurality of hair strands 202,303 comprises synthetic hair. In one embodiment, the plurality of hair strands 202,302 comprises a thermoplastic and keratin mixture that simulates human hair in appearance. Of course, combinations of synthetic and human hair could be used as well. Animal hair or other hair sources could also be used. Other hair sources will be obvious to those of ordinary skill in the art having the benefit of this disclosure.

The plurality of hair strands 202,302 can have any of a variety of lengths 205,305. For example, in one embodiment the length 205,305 of each hair strand is about seven inches. In another embodiment, the length 205,305 of each hair strand is about eight inches. The length 205,305 of the hair strands can be a function of whether the hair strands are natural or are synthetic. It may be, for example, easier or faster to make synthetic hair at longer lengths than growing and harvesting human hair.

As shown in FIG. 2, in one embodiment each strand of the plurality of hair strands 202 is each substantially straight. By contrast, as shown in FIG. 3, in another embodiment each strand of the plurality of hair strands 302 defines substantially a "one direction" curl. The term "substantially" is used herein to refer to the fact that hair, especially when it is human hair, will not perfectly or uniformly take a configuration with an ideal orientation. For example, each strand of the plurality of hair strands 202 may emanate from the weft 201 at an angle that is not perfectly orthogonal with the weft 201. However, each strand extends substantially in a straight line so as to look straight to an ordinary observer just as a person with "straight hair," while having some hair going in different directions, has an overall appearance of hair being straight.

As shown in FIG. 3, the length of each strand of the plurality of hair strands 302 curves in one direction 306. Additionally, the distal ends of each strand of the plurality of hair strands 302 is substantially directing toward a common direction 307. This configuration is thus deemed a "one direction" curl, in contrast to the curls (104,105) of FIG. 1, which curl in at least two directions (106,107).

In one embodiment, to ensure that any curls in the hair, or applied by packaging are curls in no more than one direction, the weft 201,301 is arranged in a coil along a film layer where the plurality of hair strands 202,302 extend outwardly from the coil. Explanatory methods of constructing such a coil are shown in FIGS. 4-9. These methods can be performed by hand, or alternatively by automated equipment. While these method steps illustrate a few possible methods of constructing such a coil, others will be readily obvious to those of ordinary skill in the art having the benefit of this disclosure.

Figure 4:
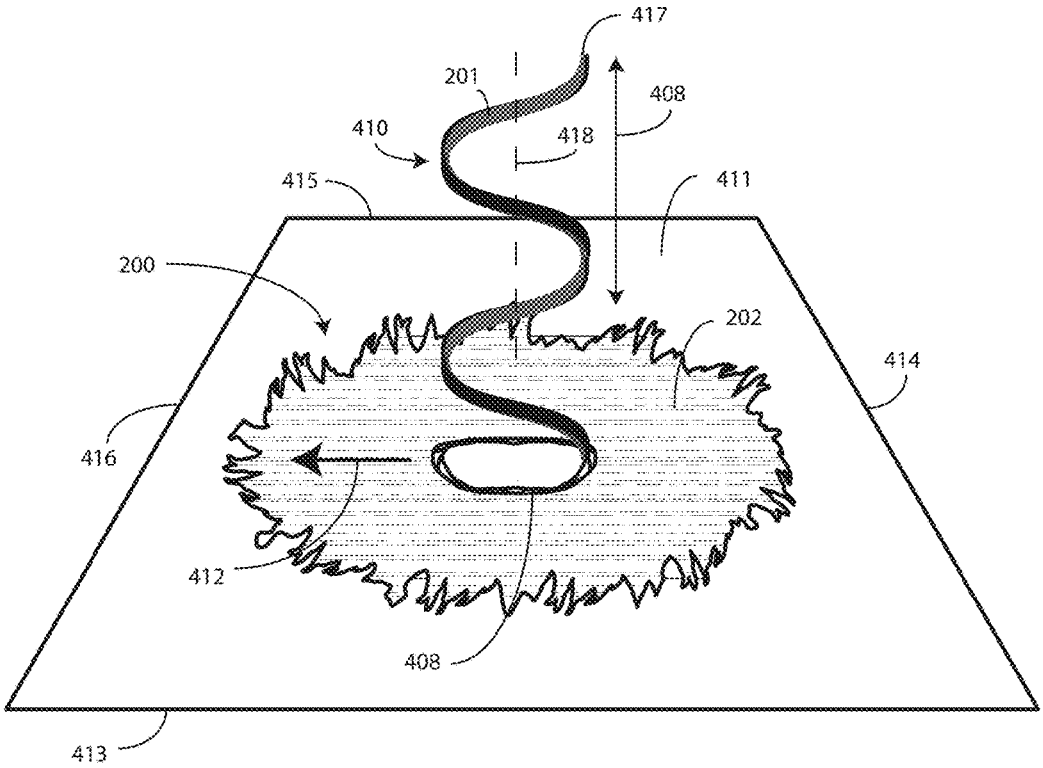
FIGS. 4-9 illustrate various explanatory method steps for coiling a weft of hair in accordance with one or more embodiments of the disclosure.
Figure 5:
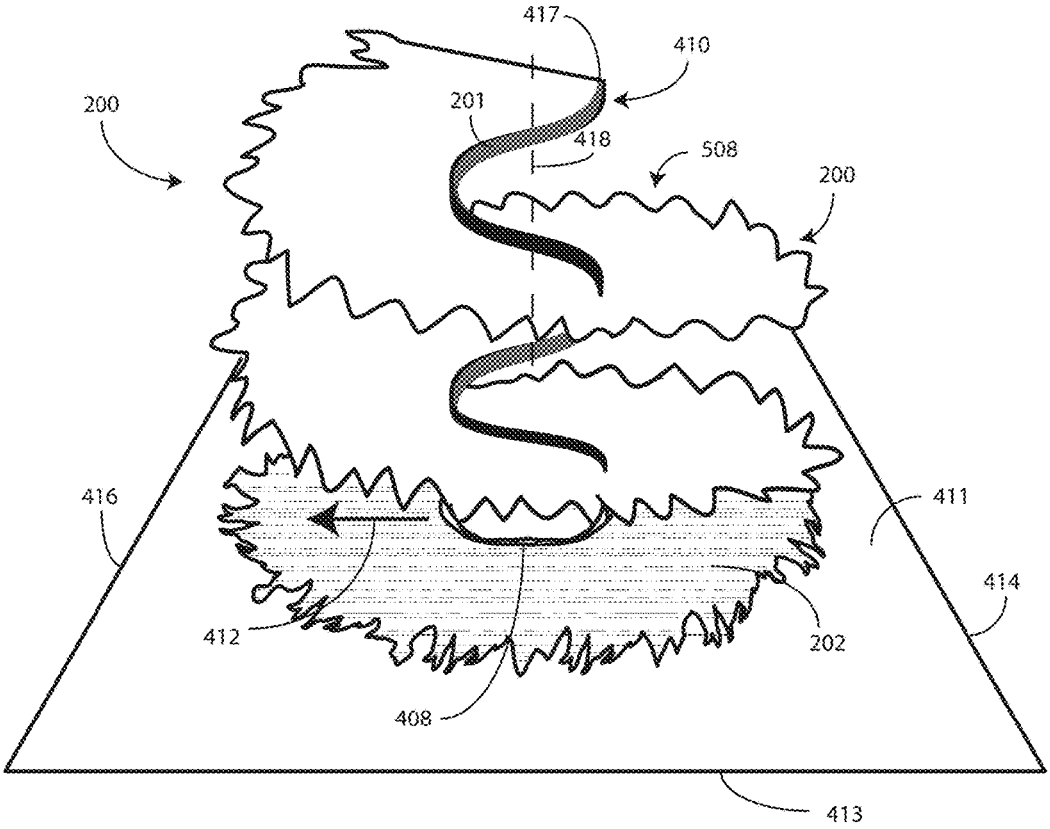
Figure 6:
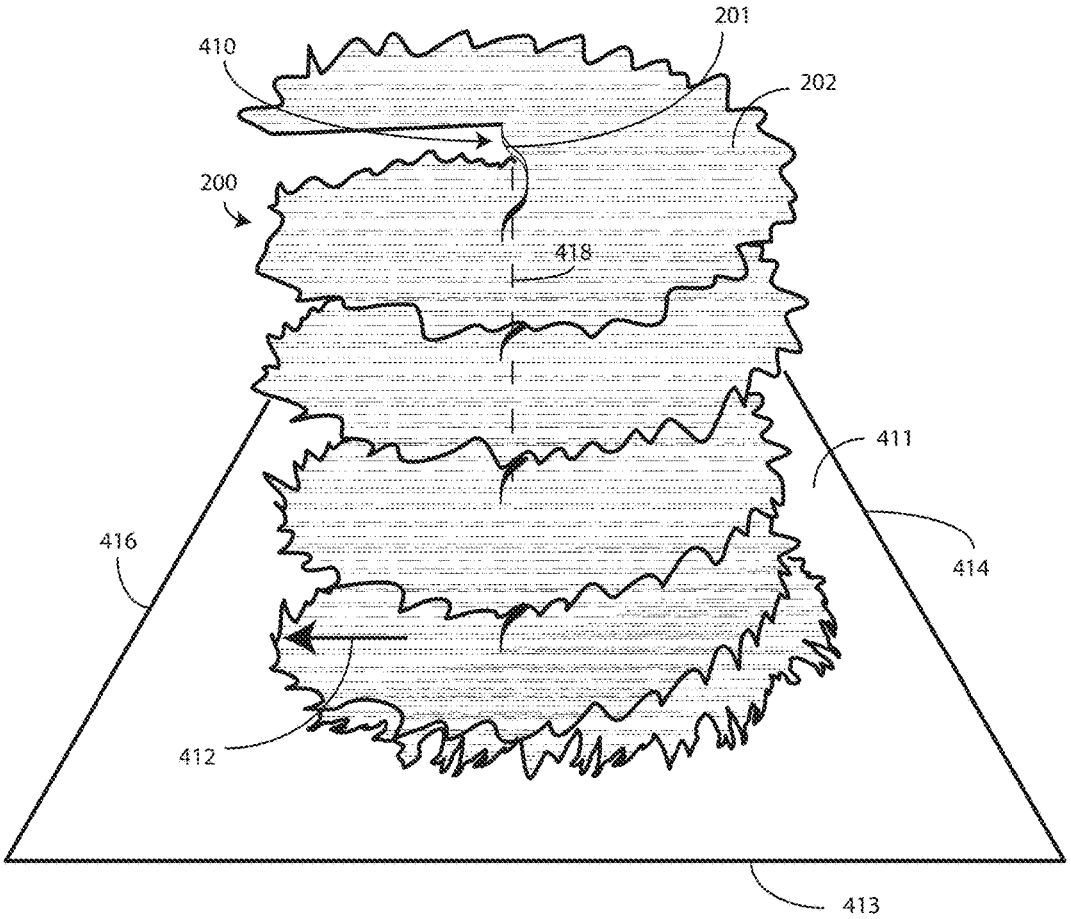

Beginning with FIGS. 4-6, illustrated therein is a first method of constructing a coil 408 in accordance with one or more embodiments of the disclosure. For ease of illustration, the hair accessory 200 of FIG. 2 will be used to describe the method. However, the hair accessory (300) of FIG. 3 could be substituted as well.

FIGS. 4-6 show different portions of the hair accessory 200 in an effort to ease explanation. For example, in FIG. 4 the hair accessory 200 is shown with the plurality of hair strands 202 removed from at least a portion of the weft 201 so that the coil 408 can be seen in addition to the coiling 410 of the weft 201. In FIG. 5 the hair accessory 200 is shown with at least some of the plurality of hair strands 202 illustrated in a transparent view so that the coiling 410 of the weft 201 can be seen. In FIG. 6, the hair accessory is shown during the coiling operation with the plurality of hair strands 202 fully attached to the weft 201 during the coiling process so that the coiling 410 of the weft 201 can be seen.

In each of these figures, the hair accessory 200 is being arranged into the coil 408 along a film layer 411. As will be described in subsequent figures, in one embodiment a manufacture configured in accordance with embodiments of the disclosure comprises a parted hair assembly. In one or more embodiments, the film layer 411 is part of the parted hair assembly in that it ensures the coil 408 does not unwind during handling.

In one embodiment, the film layer 411 comprises a thermoplastic layer. For example, the film layer 411 can comprise a clear thermoplastic film such as a polyethylene, cellophane, or polystyrene sheet. Advantageously, as will be shown below, the use of a clear film layer allows the hair accessory 200 to be fully inspected from both an interior side and an exterior side, when in the parted hair assembly configuration, without touching the hair or unwinding the coil. Other materials suitable for use as the film layer 411 will be obvious to those of ordinary skill in the art having the benefit of this disclosure.

In each of FIGS. 4-6, the weft 201 is being arranged in a coil 408 along the film layer 411 with the plurality of hair strands 202 extending outwardly 412 from the coil. As best shown in FIG. 4, in one embodiment the coil 408 defines a void at the interior of the plurality of hair strands 202, with each strand of hair extending distally in an outward direction toward edges 413,414,415,416 of the film layer 411. The coil 408, as will be shown in FIG. 10 below, can be substantially flat in one or more embodiments once the coiling or winding process is complete. The coil 408 can be substantially circular in one embodiment. Alternatively, the coil 408 can be ovoid or take other shapes.

In one embodiment, automated machinery or a person grasps one end 417 of the weft 201 and winds, rotates, or twirls the weft 201 about a winding axis 418 while lowering the weft 201 toward the film layer 411. The coil 408 can be relatively broad in some embodiments, as shown in FIGS. 4-5. This may be the case, for example, where a person is forming the coil 408. Alternatively, in other embodiments, the coil 408 can be quite narrow, as shown in FIG. 6. This may be the case where automated equipment is designed to form the coil 408. In one explanatory embodiment, the coil 408 is oval in shape with a major dimension of about four inches and a minor dimension of about two inches. Other coil configurations will be obvious to those of ordinary skill in the art having the benefit of this disclosure.

Figure 7:
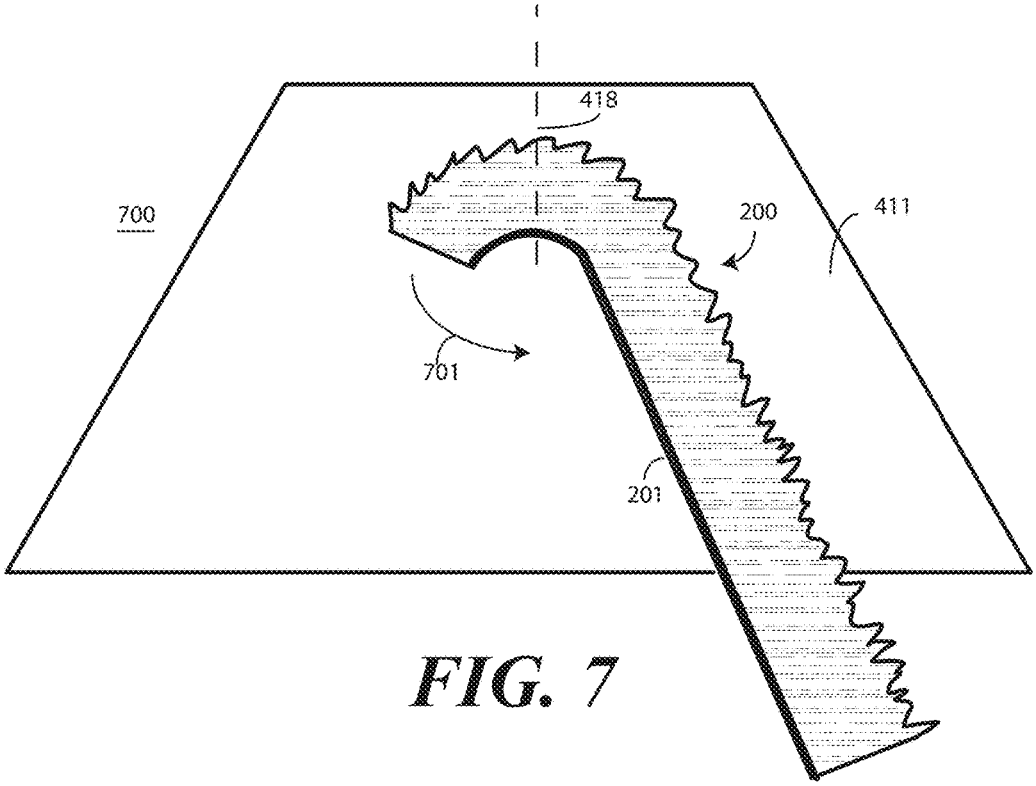
Figure 8:
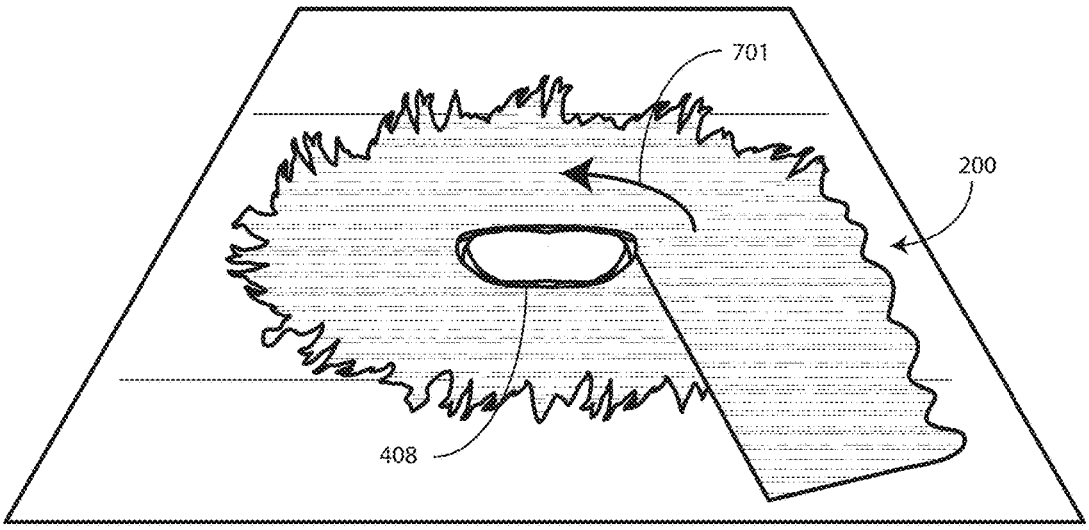

Turning now to FIGS. 7-8, illustrated therein is another explanatory method of forming the coil 408 in accordance with one or more embodiments of the disclosure. Beginning with FIG. 7, the hair accessory 200 is initially extended flat along a surface 700 with an end 417 disposed atop the film layer 411. The weft 201 is then rotated 701 about a winding axis 418, thereby drawing the remaining portions of the hair accessory atop the film layer 411. As shown in FIG. 8, the rotation 701 continues, with portions of the hair accessory 200 continuing to pile atop other portions with the coil 408 disposed at the center of the rotation 701. This process can continue until a coiled hair accessory (shown in FIG. 10) is formed.

Figure 9:
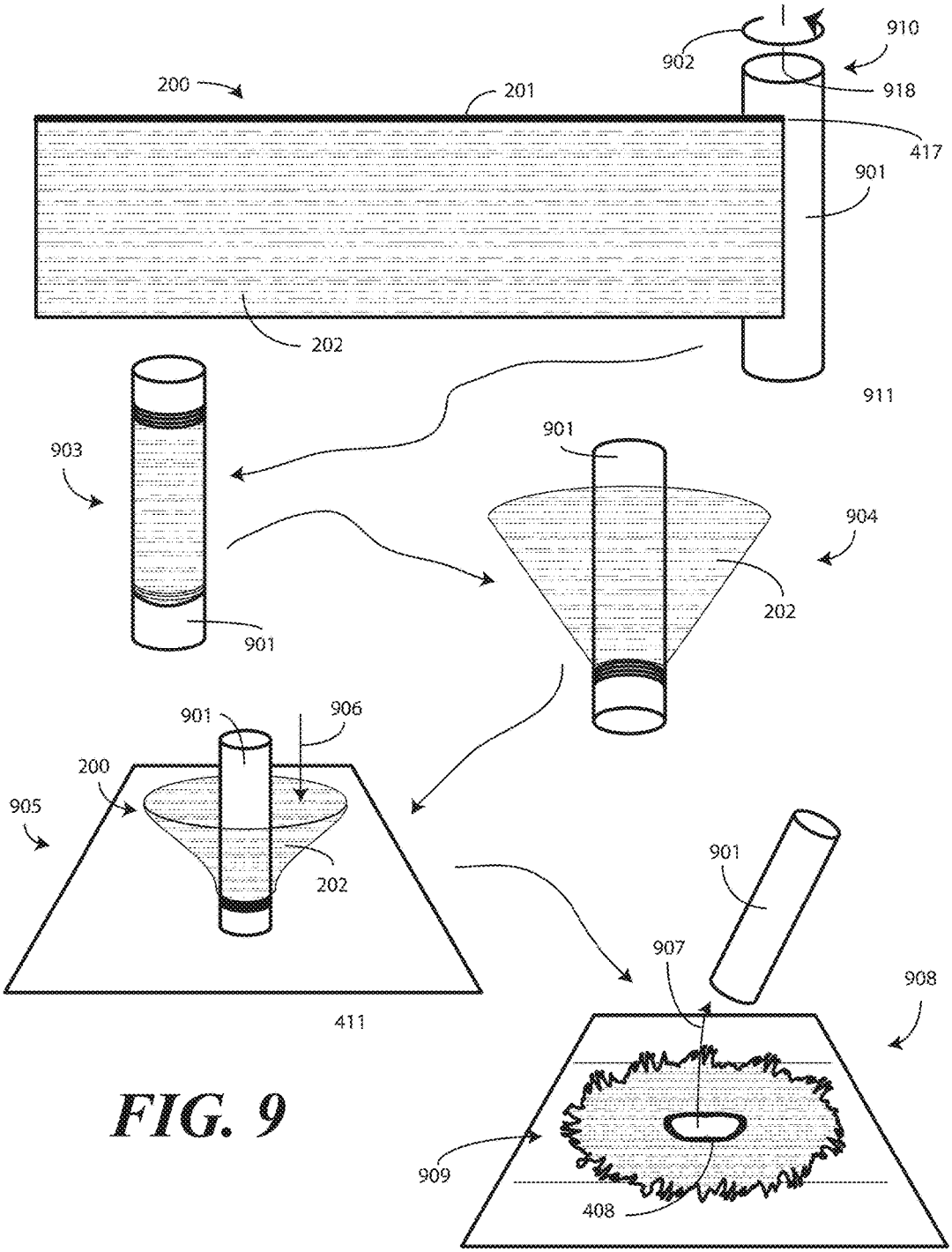

FIG. 9 illustrates yet another explanatory method for forming a coiled hair assembly in accordance with one or more embodiments of the disclosure. In FIG. 9, the coil 408 is formed with the assistance of a tool 901, which is cylindrical in this embodiment.

The hair accessory 200 is initially oriented with the weft 201 above the plurality of hair strands 202 so that gravity pulls the plurality of hair strands downward from the weft 201, thereby keeping them substantially straight. An end 417 of the weft 201 is placed against the tool 901. The tool 901 is then rotated 902 about an axis 918 to wind the hair accessory 200 about the tool 901. This completed winding process is shown at view 903.

From here, the tool 901 can be inverted, as shown at view 904. This inversion causes the plurality of hair strands 202 to begin to fall away from the tool 901. The tool 901 can then be placed over the film layer 411, as shown in view 905. The hair accessory 200 can then be slid 906 down the tool 901 toward the film layer 411. The tool 901 can then be removed 907 as shown at view 908. In sum, FIG. 9 illustrates a method where the coiled hair assembly 909 is formed by winding the weft 201 about a tool 901 such that the weft 201 is removably attached to the tool 901 at a first end 910 with the plurality of hair strands extending along the tool 901 toward a second end 911, inverting the tool 901 along the film layer 411, and removing 907 the tool 901 from the coil 408.

Figure 10:
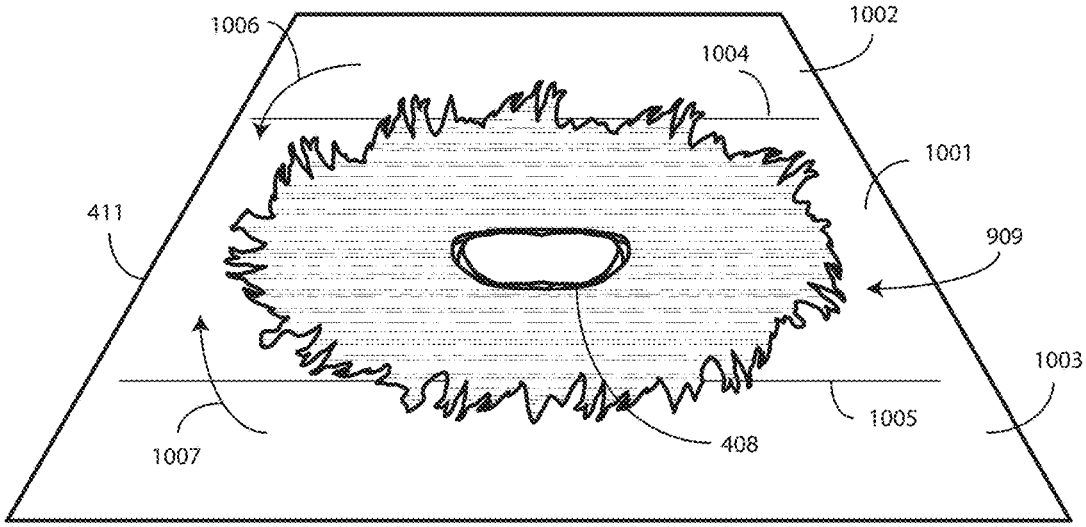
FIG. 10 illustrates a weft of hair coiled atop a film layer in accordance with one or more embodiments of the disclosure.

Turning now to FIG. 10, the coiled hair assembly 909 is atop the film layer 411. As shown in FIG. 10, in one embodiment the film layer 411 comprises a base section 1001 and one or more side sections. In this illustrative embodiment, the one or more side sections comprises a first side section 1002 and a second side section 1003, each extending distally away from sides 1004,1005 of the base section 1001. More specifically, the first side section 1002 extends distally away from a first side 1004 of the base section, while the second side 1003 extends distally away from a second side 1005 of the base section. In one embodiment, these side sections 1001,1002 can be folded 1006, 1007 about the coiled hair assembly 909 to define major faces of a resulting assembly. This will be illustrated in FIG. 12.

Figure 11:
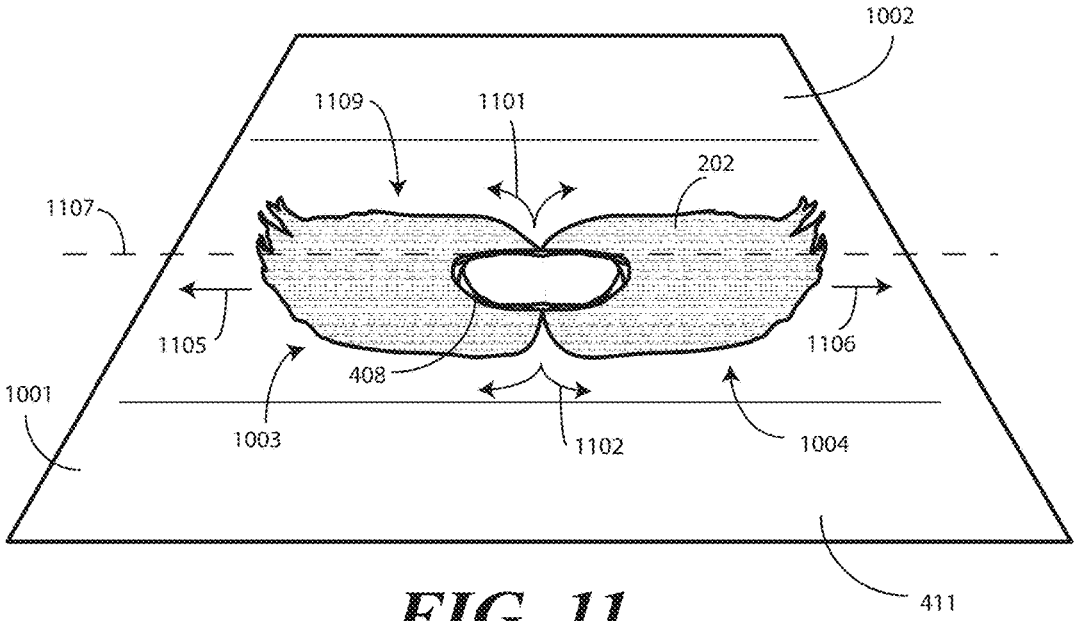
FIG. 11 illustrates a weft of hair coiled and parted atop a film layer to form a first explanatory parted hair assembly in accordance with one or more embodiments of the disclosure.

Turning now to FIG. 11, in one or more embodiments the plurality of hair strands 202 are parted 1101,1102. For example, in FIG. 11 the plurality of hair strands 202 have been parted 1101,1102 to define a first subset of hair strands 1103 extending substantially in a first direction 1105 along an axis away from the coil 408 and a second subset of hair strands 1104 extending substantially in a second direction 1106 along the central axis 1107 away from the coil 408. The first direction 1105 is opposite the second direction 1106 in this embodiment. The parting 1101,1102 occurring in FIG. 11 results in the coiled hair assembly (909) forming a parted hair assembly 1109.

It should be noted that while the parting step of FIG. 11 makes some hair at the part bend toward the first direction 1105 and the second direction 1106, respectively while the plurality of hair strands 202 is parted 1101,1102. However, this does not alter the fact that the resulting hair, when passed through the steps occurring at FIGS. 12 and 13, will have only a one directional curl. Experimental testing has shown that the hair closest to the coil 408, which is the root end, is not strongly affected when parted 1101,1102. By contrast, the tip end, which is distally located from the root end, is easily affected by manipulation. This, when the plurality of hair strands 202 are parted 1101,1102, the root end is not affected and will straighten simply due to the action of gravity when in use. By contrast, the tip end will include only the one directional curl described herein.

In one embodiment, the film layer 411 is left as is at this point. Said differently, the film layer 411 is not folded or altered. However, in other embodiments as mentioned above, side sections 1001,1002 can be folded (1006,1007) about the parted hair assembly 1109 to define major faces of a resulting assembly. This is shown in FIG. 12.

Figure 12:
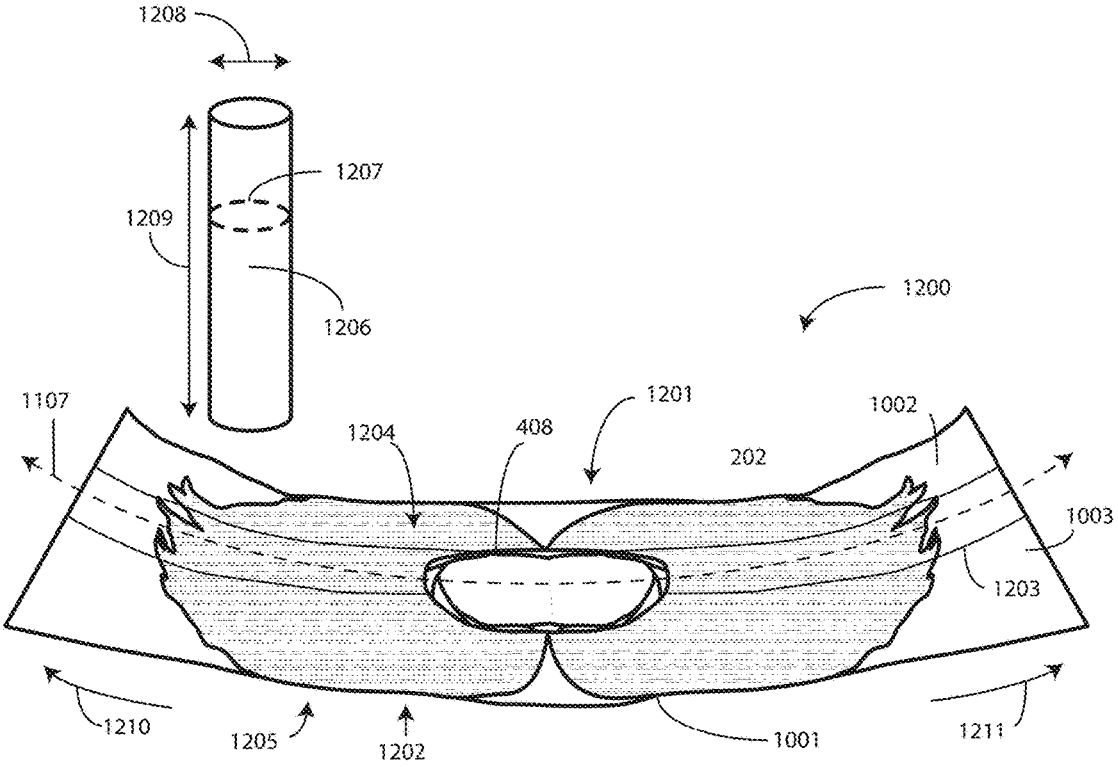
FIG. 12 illustrates another explanatory parted hair assembly in accordance with one or more embodiments of the disclosure.

Turning now to FIG. 12, the side sections 1001,1002 have been folded 1006,1007 about the parted hair assembly 1109 to define major faces 1201,1202 of another parted hair assembly 1200. The side sections 1001,1002 of this embodiment have been sealed together with a releasable adhesive 1203. One advantage of creating the parted hair assembly 1200 of FIG. 12 is that a prospective purchaser or user can inspect both the interior side 1204 and the exterior side 1205 of the parted hair assembly 1200 without touching or manipulating the plurality of hair strands 202, and without disturbing the coil 408.

In the illustrative embodiment of FIG. 12, the base section 1001 defines a first major face 1202 of the parted hair assembly 1200. Meanwhile, the first side section 1101 and the second side section 1102 are folded about the coil 408 to define a second major face 1201 of the parted hair assembly 1200. In this illustrative embodiment, the first side section 1101 and the second side section 1102 are adhesively attached together with the releasable adhesive 1203, which is optional, to define the second major face 1201 of the parted hair assembly 1200.

Also shown in FIG. 12 is a support 1206. The explanatory support 1206 is cylindrical in shape in this embodiment. However, the cross section of the support 1206 could take other shapes as well. As will be described below, the support 1206 can help define the one directional curl in one or more embodiments. Accordingly, altering the shape of the support 1206 will alter the definition of the one directional curl. For example, making the cross section 1207 of the support 1206 ovular will result in a wider one directional curl, while making the cross section 1207 of the support 1206 circular will result in a narrower one directional curl. Making the diameter 1208 of the support 1206 smaller will result in a tighter one directional curl, while making the diameter 1208 larger will result in a looser one directional curl.

As will be shown below, in one or more embodiments the parted hair assembly 1200 will be wrapped about the support 1206 along the central axis 1107. Since the plurality of hair strands 202 are parted (1101,1102), the length 1209 of the support 1206 can advantageously be shorter than the length of the strands of hair. This results in a more compact packaging or manufacture. Illustrating by example, in one embodiment each strand of hair is eight or more inches in length, while the length 1209 of the support 1206 is only about seven and a half inches, which is less than the length of each strand of hair.

The support 1206 can be manufactured from a variety of materials, including thermoplastic materials. For example, in one embodiment the support 1206 is manufactured from styrofoam. In another embodiment, the support 1206 is manufactured from polystyrene. In yet another embodiment, the support 1206 is manufactured from one of polyethylene, polybutadiene, or polyurethane. Other materials include cardboard, papier-mache, inflated flexible plastic or rubber, or from any of foamed plastic, flexible plastic, rubber, wood, metal, or combinations thereof.

The parted hair assembly 1200 of FIG. 12 is illustrated as not being perfectly flat because, as will be shown below in FIG. 13, in one embodiment the parted hair assembly 1200 is wrapped about the support 1206 along the central axis 1107. This occurs such that the curls of substantially all of the plurality of hair strands define a one directional curl, which is illustrated by curves 1211,1212 in FIG. 12.

Figure 13:
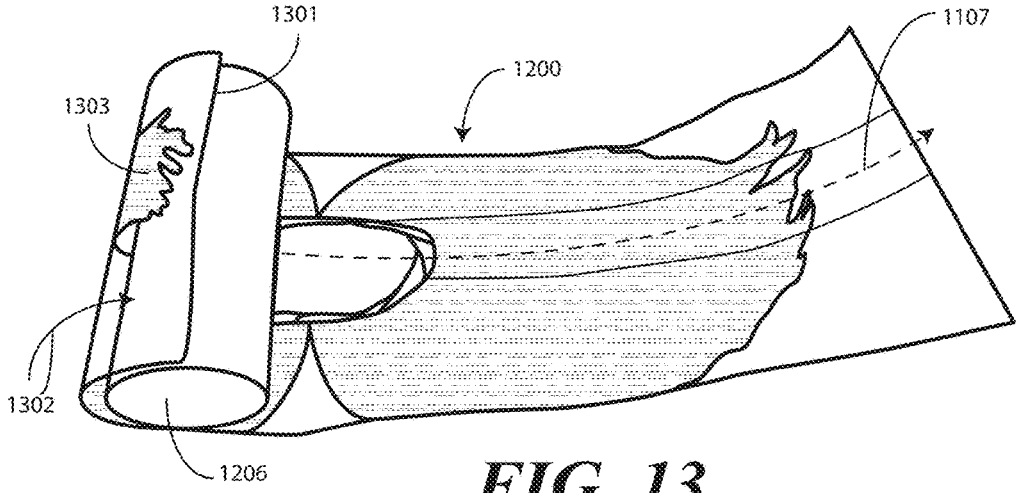
FIG. 13 illustrates one or more method steps to construct an explanatory manufacture in accordance with one or more embodiments of the disclosure.

Turning to FIG. 13, a first end 1301 of the parted hair assembly 1200 has been placed against the support 1206. The parted hair assembly 1200 can optionally be attached to the support 1206 with an adhesive, tape, or pin in one or more embodiments. The support 1206 is then rotated 1302 to wrap the parted hair assembly 1200 about the support 1206. This wrapping in a common direction along the central axis 1107 results in the parted hair assembly 1200 being wrapped about the support 1206 such that curls of substantially all of the plurality of hair strands 202 advantageously define a one directional curl 1303. The wrapping 1401 continues in FIG. 14, with parted hair assembly 1200 being wrapped about the support 1206 in FIG. 15.

Figure 16:
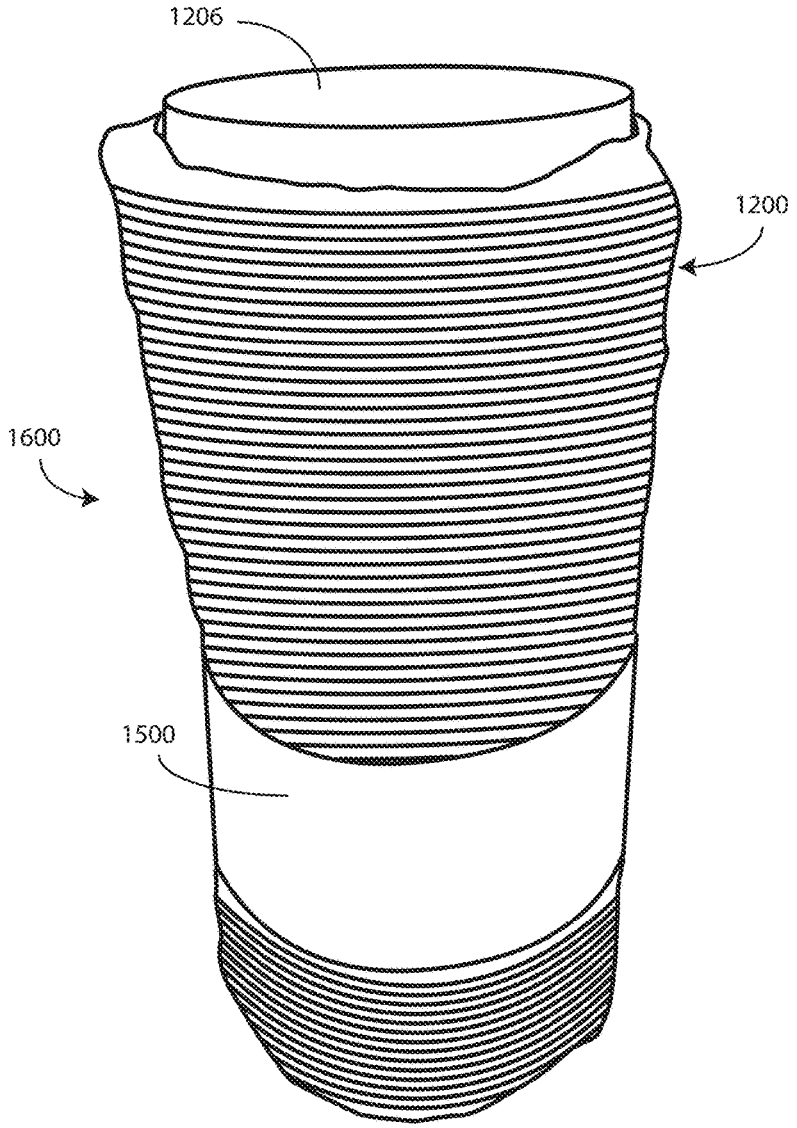
FIG. 16 illustrates an explanatory manufacture in accordance with one or more embodiments of the disclosure.

Also shown in FIG. 15 is a band 1500, which can be manufactured from paper, cardboard, or other materials. The band 1500 can include printed indicia disposed thereon that identify the type of hair, branding, or provides other additional information. In one or more embodiments, the band 1500 can be disposed about the parted hair assembly 1200 wrapped about the support 1206 to form a wrapped hair assembly 1600, which is shown in FIG. 16. In one or more embodiments, the band 1500 is selectively removable and/or replaceable so as to selectively retain the parted hair assembly 1200 in a wrapped configuration about the support 1206.

The removability of the band 1500 facilitates one of the many advantages of embodiments of the disclosure. When inspecting the parted hair assembly 1200 prior to purchase, a prospective consumer can reverse the method steps occurring in FIGS. 12-16 to unwrap the parted hair assembly 1200 from the support 1206. The person can then inspect both the interior side (1204) and the exterior side (1205) of the hair to ensure that it meets their requirements prior to purchase. If for some reason they prefer another color or type of hair, they simply repeat the steps of FIGS. 12-16 set forth above to return the parted hair assembly 1200 to the wrapped hair assembly 1600 of FIG. 16. This can be done without soiling or altering the plurality of hair strands (202). Moreover, it can be done without changing or altering the one directional curl (1210), or without uncoiling the coil (408). Prior art hair packaging cannot do this.

Figure 17:
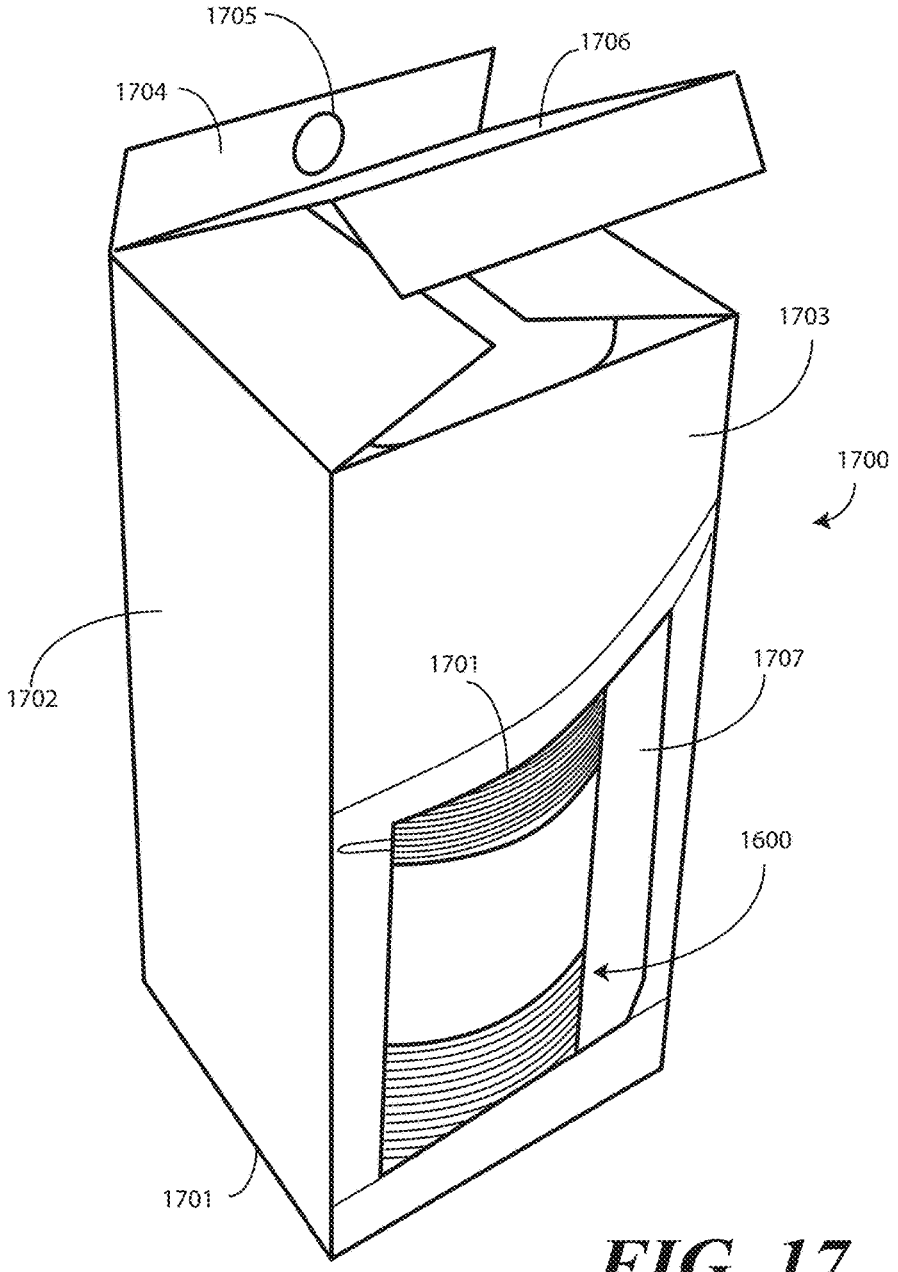
FIG. 17 illustrates another explanatory manufacture in accordance with one or more embodiments of the disclosure.

Turning now to FIG. 17, once the wrapped hair assembly 1600 is completed, in one embodiment it is placed into a box 1700. Other containers, such as bags, pouches, shrink-wraps, and so forth can be substituted for the box 1700. In the illustrative embodiment of FIG. 17, the box 1700 is a windowed box comprising a stylistic window 1701 through which the wrapped hair assembly 1600 can be seen by a prospective purchaser.

As shown in FIG. 17, the box 1700 defines an enclosure for the wrapped hair assembly 1600 that includes a bottom 1701, one or more side walls 1702,1703, an optional hang tab extension 1704 that includes a hang tab 1705, and an openable top 1706 configured as a flap. The stylistic window 1701 can be sealed with transparent layer of film 1707. In one or more embodiments, the box 1700 can be manufactured by folding a die, which is a single piece of material, to form the box as is known in the art.

Figure 18:
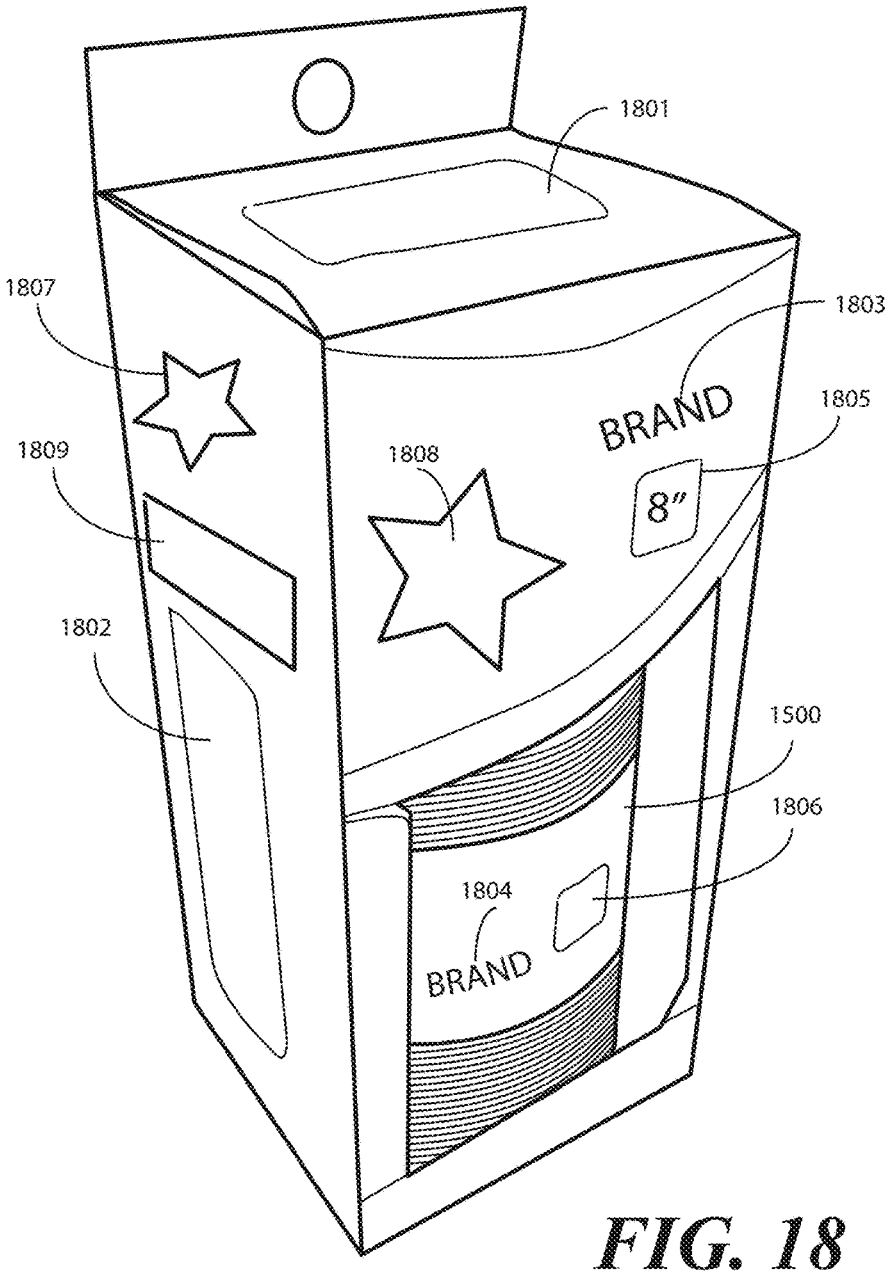
FIG. 18 illustrates explanatory manufacture in accordance with one or more embodiments of the disclosure.

Turning now to FIG. 18, in one or more embodiments the box 1700 carries various visible indicia. For example, in one or more embodiments the box 1700 includes a token 1801, 1802 indicating the characteristics of the hair disposed within the box 1700. These characteristics may include the fact that the hair is human hair, that the hair is of a certain grade, or that the hair has characteristics such as being tangle free or including a one directional curl. As used herein, a "token" takes the principal meaning from the dictionary, which is that of "a thing serving as a visible or tangible representation of a fact or quality." Thus, in one embodiment, the token 1801,1802 may comprise indicia stating, "100% World's Finest Human Hair." In another embodiment, the token 1801,1802 is suggestive in nature. As an example, it may indicate that the hair is "tangle free." This token information may be placed on the band 1500 as well. These tokens are illustrative only, as others will be obvious to those of ordinary skill in the art having the benefit of this disclosure.

In one or more embodiments, one or more of the box 1700 or the band 1500 can include brand information 1803,1804 information as well. One or more of the box 1700 or the band 1500 can further include technical specifications 1805, 1806, such as the fact that the hair disposed within the box 1700 is eight inches in length. In some embodiments, optional graphical indicia 1807,1808 can be placed on the box 1700 as well. Such graphical indicia 1807,1808 may include pictures of the hair product in use as one example. Other information suitable for presentation on the box 1700 will be obvious to those of ordinary skill in the art having the benefit of this disclosure.

In one embodiment the box 1700 includes instructional material and/or suggestions 1809 for using the hair product. The instructional material and/or suggestions 1809 for using the hair product may teach a user how to care for the hair product, how to clean the hair product, and so forth.

Figure 19:
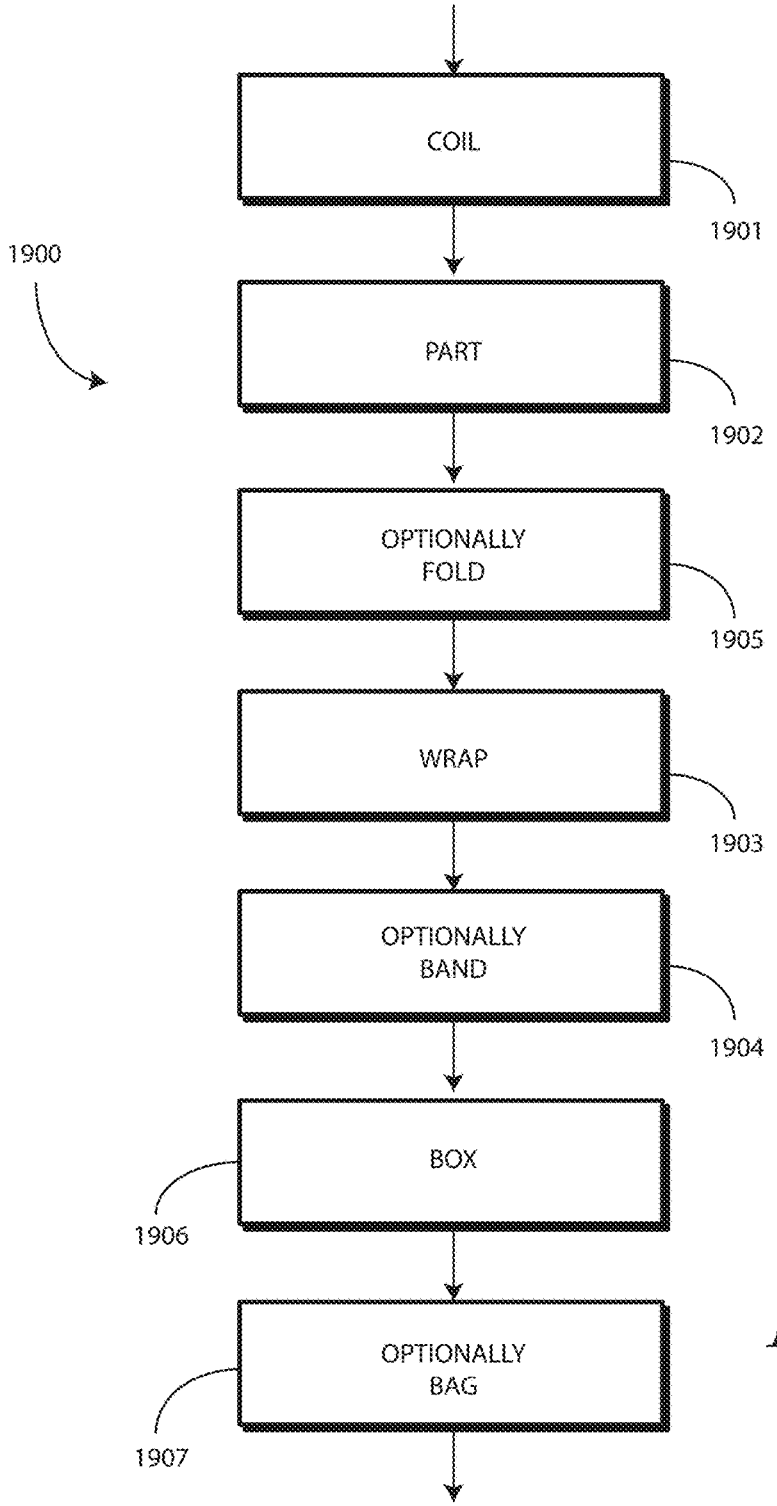
FIG. 19 illustrates an explanatory method in accordance with one or more embodiments of the disclosure.

Turning now to FIG. 19, illustrated therein is one explanatory method 1900 of constructing a manufacture in accordance with one or more embodiments of the disclosure. At step 1901, the method 1900 includes coiling a weft of a hair accessory atop a film layer to form a coil with a plurality of hair strands extending outwardly from the coil. The coiling step 1901 can be accomplished in one of a variety of ways. In one embodiment, a tool is used to complete the coiling step 1901. For example, in one embodiment the coiling of step 1901 includes winding the weft about a tool such that the weft is removably attached to the tool at a first end with the plurality of hair strands extending along the tool toward a second end. The step 1901 can then include inverting the tool along the film layer, and removing the tool from the coil. Other methods have been described above. Still others will be obvious to those of ordinary skill in the art having the benefit of this disclosure.

At step 1902, the method 1900 includes parting the plurality of hair strands. In one embodiment, this parting occurring at step 1902 results in the definition of a first subset of hair strands extending substantially in a first direction from the coil and a second subset of hair strands extending substantially in a second direction, opposite the first direction, from the coil to form a parted hair assembly.

At step 1903, the method 1900 includes wrapping the parted hair assembly about the support. In one embodiment, this step 1903 causes substantially all of the plurality of hair strands define a one directional curl created by the fact that the hair is wrapped about a support that defines curl configuration and definition.

In one embodiment, the method 1900 further optionally includes, at step 1904, placing a band about the parted hair assembly to retain the parted hair assembly in a wrapped configuration about the support. In one embodiment, the method 1900 optionally includes at step 2305 folding the film layer about the parted hair assembly prior to the wrapping step 1903. At step 1906, the method 1900 includes disposing the wrapped configuration in a windowed box. At optional step 1907, the box can be placed in a bag.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A manufacture, comprising:

a hair accessory comprising a weft and a plurality of hair strands extending distally from a common side of the weft;

a film layer; and a support;

the weft arranged in a coil along the film layer with the plurality of hair strands extending outwardly from the coil;

the plurality of hair strands parted to define a first subset of hair strands extending substantially in a first direction from the coil and a second subset of hair strands extending substantially in a second direction from the coil to form a parted hair assembly, the second direction opposite the first direction; and the parted hair assembly wrapped about the support.

2. The manufacture of claim 1, the film layer comprises a base section, one or more side sections, the base section defining a first major face of the parted hair assembly and the one or more side sections folded about the coil to define a second major face of the parted hair assembly.

3. The manufacture of claim 2, the one or more side sections comprising a first side section extending distally from a first side of the base section and a second side section extending distally from a second side of the base section.

4. The manufacture of claim 3, the first side section and the second side section adhesively attached together to define the second major face of the parted hair assembly.

5. The manufacture of claim 1, the parted hair assembly wrapped about the support such that curls of substantially all of the plurality of hair strands define a one directional curl.

6. The manufacture of claim 5, the support defining a cylindrical shape.

7. The manufacture of claim 5, the support manufactured from any of foamed plastic, polystyrene, polybutadiene, polyethylene, polyurethane, cardboard, flexible plastic or rubber filled with air, papier-mache, wood, metal, or combinations thereof.

8. The manufacture of claim 5, further comprising a band disposed about the parted hair assembly wrapped about the support to form a wrapped hair assembly.

9. The manufacture of claim 8, the band removable to selectively retain the parted hair assembly wrapped about the support.

10. The manufacture of claim 9, the wrapped hair assembly disposed within a windowed box.

11. The manufacture of claim 10, the windowed box disposed in a bag having a major dimension greater than twice a height of the windowed box.

12. The manufacture of claim 11, a portion of the bag extending distally from the windowed box along the major dimension folded about at least three sides of the windowed box.

13. The manufacture of claim 5, the plurality of hair strands comprising any of human hair, synthetic hair, or combinations thereof.

14. The manufacture of claim 1, the film layer comprising a clear thermoplastic film.

* * * * *